US007429832B2

(12) United States Patent
Foo

(10) Patent No.: US 7,429,832 B2
(45) Date of Patent: Sep. 30, 2008

(54) LIGHT CONTROL FLUORESCENT LAMP AND CIRCUIT THEREOF

(75) Inventor: Onn Fah Foo, Kowloon (HK)

(73) Assignee: Mass Technology (H.K.) Ltd., Kowloon (HK)

( * ) Notice: Subject to any disclaimer, the term of this patent is extended or adjusted under 35 U.S.C. 154(b) by 0 days.

(21) Appl. No.: 11/739,235

(22) Filed: Apr. 24, 2007

(65) Prior Publication Data

US 2007/0252534 A1 Nov. 1, 2007

(30) Foreign Application Priority Data

Apr. 27, 2006 (CN) ..... 2006 1 0079979

(51) Int. Cl.
*H05B 37/02* (2006.01)

(52) U.S. Cl. ..... 315/291; 315/307

(58) Field of Classification Search ..... 315/209 R, 315/224–226, 291, 307–308, DIG. 4
See application file for complete search history.

(56) References Cited

U.S. PATENT DOCUMENTS 5,739,645 A * 4/1998 Xia et al. ..... 315/307
5,925,990 A * 7/1999 Crouse et al. ..... 315/307
6,008,593 A * 12/1999 Ribarich ..... 315/307
6,107,754 A * 8/2000 Kim ..... 315/291
6,377,000 B2 * 4/2002 Kim ..... 315/307
6,486,616 B1 * 11/2002 Liu et al. ..... 315/291
6,628,093 B2 * 9/2003 Stevens ..... 315/291
2002/0047636 A1 * 4/2002 Yamamoto et al. ..... 315/291
2007/0090775 A1 * 4/2007 Ribarich ..... 315/291

FOREIGN PATENT DOCUMENTS

CN 2181159 Y 10/1994
CN 2468257 Y 12/2001

* cited by examiner

*Primary Examiner*—Thuy Vinh Tran
*Assistant Examiner*—Tung X Le
(74) *Attorney, Agent, or Firm*—Rabin & Berdo, P.C.

(57) ABSTRACT

A light control circuit for use in light control fluorescent lamps comprises a filter and rectifier circuit (1), a frequency control and resonant circuit (2) and an ambient brightness signal sampling and control circuit (4); wherein the ambient brightness signal sampling and control circuit (4) advantageously adopts an integrated circuit (U1) to control or adjust light sensitivity of the light control circuit in an accurate manner and to control the onoff of the light control circuit in an intelligent way such that the output of the light control circuit is not susceptible to a sudden change of the ambient brightness.

16 Claims, 3 Drawing Sheets

LIGHT CONTROL FLUORESCENT LAMP AND CIRCUIT THEREOF

TECHNICAL FIELD

The present invention relates to a light control fluorescent lamp, and more particularly to a compact type fluorescent lamp which can be automatically turned on and off in accordance with the brightness of the external environment and a light control circuit integrated therewith.

BACKGROUND OF THE INVENTION

Environment conservation and energy saving are matters of increasing concern to the public, wherein the reduction of electric lighting energy is particularly of economical value and practical to implement. To this end, various energy saving light control lamps or switches have been developed, for example, CN 2181159 disclosed an energy saving lamp wherein the onoff of the lamp is controlled with a photoresistor and a thyristor, but which is basically adapted for use in low power illumination. CN 2468257 disclosed a light control lamp having a light control switch, wherein the photosensitivity and onoff of the lamp are controlled with a photoresistor, a potentiometer, an integrated triggering block and a relay. While it employs elements having relatively large sizes, e.g. transformer, potentiometer and relay, the ohmic dissipation thereof is relatively high and a relatively large space is also required for proper installation.

Further, a lamp bulb or a lamp tube is more and more commonly replaced in various places with a compact type fluorescent lamp. While there is a very limited space for installation of the compact type fluorescent lamp, such light control lamps cannot be adapted for use therewith in view of their dimension and other factors, such as the parts being employed therein or the like. To this end, CN patent application number 200610009296.9 submitted by the same applicant of the present patent application disclosed a light control fluorescent lamp, and more particularly a compact type light control fluorescent lamp and its light control circuit, wherein two programmable integrated circuits IC1, IC2 are employed to control or adjust the photosensitivity and onoff thereof in a relatively accurate manner such that the lamp is not susceptible to a sudden change of the ambient brightness. The cost of such compact type light control fluorescent lamp is relatively high as it employs two integrated circuits. Whereas the body of the compact type light control fluorescent lamp is generally of spherical or round shape, the coverage of the single photoresistor might probably be restricted such that under certain circumstances it will operate improperly. For example, it will erroneously turn off while it was irradiated at a direction for a relatively long duration by a head light of a vehicle amid traffic congestion, and besides, it will erroneously turn on while the photoresistor thereof being obstructed by chance.

SUMMARY OF THE INVENTION

An object of the present invention is to overcome at least partly the above defects in the prior art by providing a light control fluorescent lamp, particularly a compact type light control fluorescent lamp embedded with a light control circuit wherein only one integrated circuit and at least one photosensitive element are employed to reduce the cost and further enhance the photosensitivity and immunity to a sudden change of the ambient brightness of the lamp such that it could be applied even more widely in various circumstances.

Accordingly, the technical solution of the present invention provided for the above object being a light control circuit for use in light control fluorescent lamps, which comprises a filter and rectifier circuit with its input coupled to an AC power supply; a frequency control and resonant circuit with its input coupled to output of the filter and rectifier circuit; an ambient brightness signal sampling and control circuit with its input coupled to the output of the filter and rectifier circuit while its output being coupled to the frequency control and resonant circuit; the ambient brightness signal sampling and control circuit includes a programmable integrated circuit and a resistor R1 serially connected to a capacitor C3 in shunt connection with a polarized capacitor C2 and a zener diode Z1 between a positive input and a negative input of the ambient brightness signal sampling and control circuit; wherein a power supply pin VDD is coupled to a connection point between the resistor R1 and the capacitor C3, and a ground pin GND and the negative input being grounded together. The integrated circuit of the ambient brightness signal sampling and control circuit comprises at least one input pin GP0, GP2, an output pin GP1 and a specific program for controlling working mode of the light control circuit; the ambient brightness signal sampling and control circuit further comprises a photosensitive element in shunt connection with a capacitor C4, C6 being respectively connected between the at least one input pin GP0, GP2 and the negative input; a resistor R2, R3 respectively connected between the at least one input pin GP0, GP2 and the power supply pin VDD; and a resistor R5 being connected to the output pin GP1 at one end and coupled to a control gate of a thyristor Q3 at another end, and a resistor R4 and a capacitor C 11 being in shunt connection between the gate and a cathode of the thyristor Q3 to which the negative input is connected.

According to a preferred embodiment of the present invention, the photosensitive element is a photoresistor. Alternatively, it can be a photodiode or phototransistor for enhancing the photosensitivity thereof. While two photosensitive elements are employed, they can be disposed axially and separately at a specific angle, preferably at 180°. While more than two photosensitive elements are employed, the specific angle can be correspondingly adjusted such that they can be arranged axially and separated evenly for achieving the preferred effects. Preferably, the programmable integrated circuit is a PIC12F510, PIC12F675, PIC10F200, PIC10F202, PIC10F204, PIC10F206, PIC10F220, PIC10F222 or any other functionally equivalent integrated circuit.

The specific program according to a preferred embodiment of the present invention is configured to continuously detect the ambient brightness for a single or multiple times in a predetermined interval with the at least one photosensitive element and then selectively operates in turnon, intermediate or turnoff modes based on detected brightness value thereby controlling the onoff of the light control circuit correspondingly. Preferably, the specific program is configured to enable the light control circuit to go through, once coupled to the power supply, a response lag of 1-10 seconds during which the ambient brightness is detected and determined for enabling it to control the onoff of the light control circuit correspondingly.

Preferably, the specific program is configured to enable the ambient brightness signal sampling and control circuit to operate in the turnon mode or intermediate mode thereby rendering the light control circuit to be turned on or remained on while the ambient brightness being actually remained below a lower threshold for a specific duration. Similarly, the specific program is configured to enable the ambient brightness signal sampling and control circuit to operate in the turnoff mode or intermediate mode thereby rendering the light control circuit to be turned off or remained off while the ambient brightness being actually remained above an upper threshold for a specific duration. Preferably, the specific duration ranges from 0 to 300 seconds and can be adjusted as required. The ambient brightness signal sampling and control circuit is configured to keep the latest working mode of the light control circuit unchanged while operating in the intermediate mode such that a smooth and stable operation of the light control circuit can be maintained.

According to the preferred embodiments of the present invention, a light control fluorescent lamp and more particularly a compact type light control fluorescent lamp having an easily adjustable light sensitivity and being not susceptible to a sudden change of the ambient brightness can be realized by means of a light control circuit of the foregoing type. While it is simple in construction, stable in performance and small in size in view of the electronic devices used therewith, it can be selectively integrated with a fluorescent lamp, particularly a compact type fluorescent lamp. Further, as it employs only one integrated circuit and at least one photosensitive element, the cost thereof is relatively low and the employment of a plurality of photosensitive elements provides a relatively large coverage for the detection of ambient brightness. In addition, the specific program in the programmable integrated circuit enables selective calculations and compensations of detected values of each of the photosensitive elements thereby further enhancing the photosensitivity of the light control circuit and its immunity to the sudden changes of the ambient brightness.

BRIEF DESCRIPTION OF THE DRAWINGS

The further objects, features, characteristics and effects of the present invention will be illustrated in more details by way of example with reference to the accompany drawings, wherein.

DETAILED DESCRIPTION OF THE PREFERRED EMBODIMENTS

Figure 1:
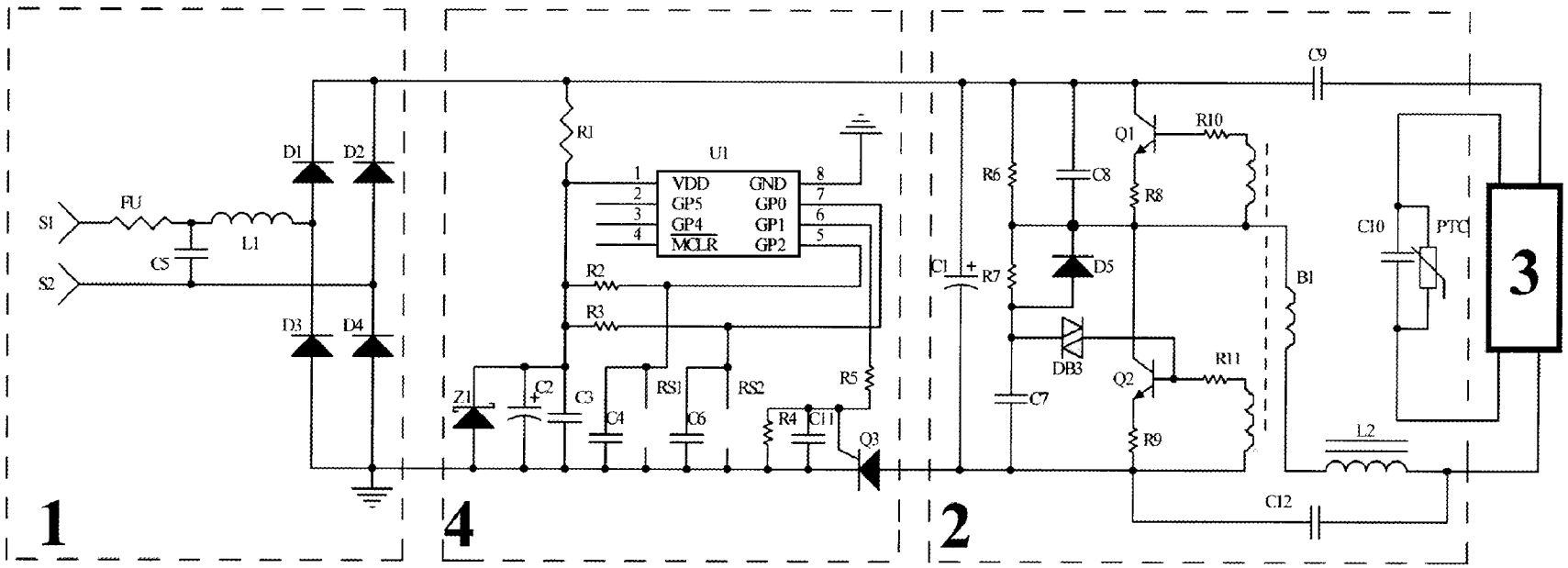
FIG. 1 is a block diagram of a light control fluorescent lamp with its light control circuit according to a preferred embodiment of the present invention.

FIG. 1 illustrates a block diagram of a light control fluorescent lamp with its light control circuit according to a preferred embodiment of the present invention. The light control circuit comprises a filter and rectifier circuit 1 with its input coupled to an AC power supply; a frequency control and resonant circuit 2 with its input coupled to output of the filter and rectifier circuit; an ambient brightness signal sampling and control circuit 4 with its input coupled to the output of the filter and rectifier circuit 1 while its output being coupled to the frequency control and resonant circuit 2.

The filter and rectifier circuit 1 comprises a typical filter (FU, C5, L1) and rectifier circuit D1-D4 capable of converting an ac input power into a dc output power, which having its positive output coupled to the frequency control and resonant circuit 2 and the ambient brightness signal sampling and control circuit 4 while it negative output is grounded.

The frequency control and resonant circuit 2 is coupled to output of the filter and rectifier circuit 1 with its input and its output is coupled to a lamp load 3. The frequency control and resonant circuit 2 according to the embodiment is a common half bridge oscillated circuit comprising a electrolytic capacitor C1 for filtering; a trigger circuit comprised of resistors R6, R7, capacitors C7, C8, a diode D5 and a trigger diode DB3 for providing a pulse current for initiating the frequency control and resonant circuit 2. A half bridge circuit is formed from transistors Q1, Q2, wherein the transistor Q1 is coupled to a resistor R10 at its base and a resistor R8 at its emitter while the transistor Q2 is coupled to a resistor R11 at its base and a resistor R9 at its emitter. The frequency control and resonant circuit 2 further comprises a set of three winding toroidal magnetic unit B1 for providing feedback current and drive current to the transistors Q1, Q2; a direct current blocking capacitor C9; a choking inductor L2; and a capacitor C12 connected between grounding end of the resistor R9 and input end of the inductor L2.

The lamp load 3 according to the embodiment of the present invention having two contacts at both ends, wherein the output end of the capacitor C9 and input end of the inductor L2 of the frequency control and resonant circuit 2 are respectively connected with one of the contacts at opposite ends of the lamp load 3, while a capacitor C10 in shunt connection with a preheating device PTC being connected across the other two contacts of the lamp load 3.

The ambient brightness signal sampling and control circuit 4 includes a programmable integrated circuit U1 and a resistor R1 serially connected to a capacitor C3 in shunt connection with a polarized capacitor C2 and a zener diode Z1 between a positive input and a negative input of the ambient brightness signal sampling and control circuit 4; wherein a power supply pin VDD of the integrated circuit U1 is coupled to a connection point between the resistor R1 and the capacitor C3, and a ground pin GND of U1 and the negative input being grounded together. The integrated circuit U1 comprises at least one input pin (GP0, GP2), an output pin GP1 and a specific program for controlling working mode of the light control circuit; the ambient brightness signal sampling and control circuit 4 further comprises a photosensitive element in shunt connection with a capacitor (C4, C6) being respectively connected between the at least one input pin (GP0, GP2) and the negative input; a resistor (R2, R3) respectively connected between the at least one input pin (GP0, GP2) and the power supply pin VDD; and a resistor R5 being connected to the output pin GP1 at one end and coupled to a gate of a thyristor Q3 at another end, and a resistor R4 and a capacitor C11 being in shunt connection between the gate and a cathode of the thyristor Q3; and the cathode of the thyristor Q3 is further connected to the negative input. The anode of the thyristor Q3 acts as the output end and is connected with the negative terminal of the electrolytic capacitor C1 of the frequency control and resonant circuit 2.

Figure 2:
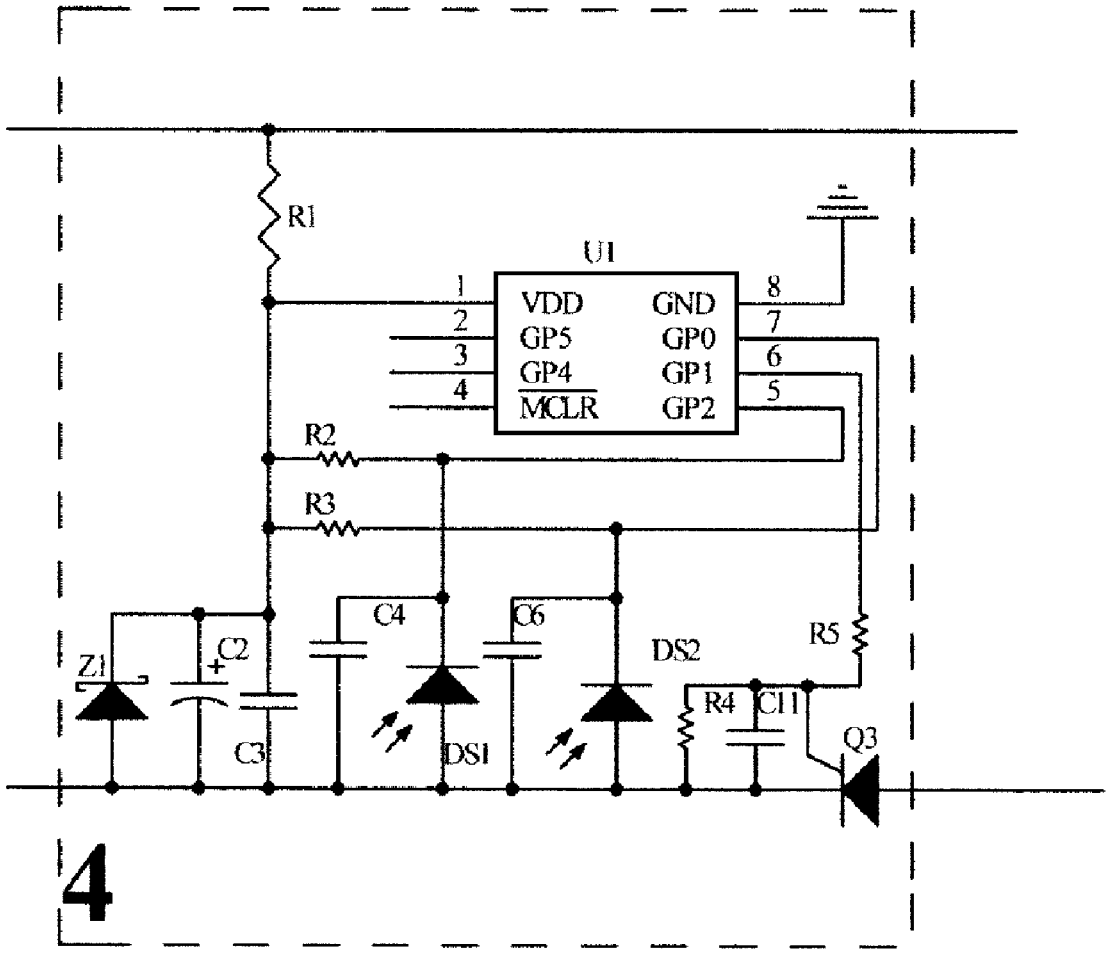
FIG. 2 is a circuit diagram of an ambient brightness signal sampling and control circuit of a light control circuit according to another preferred embodiment of the present invention.
Figure 3:
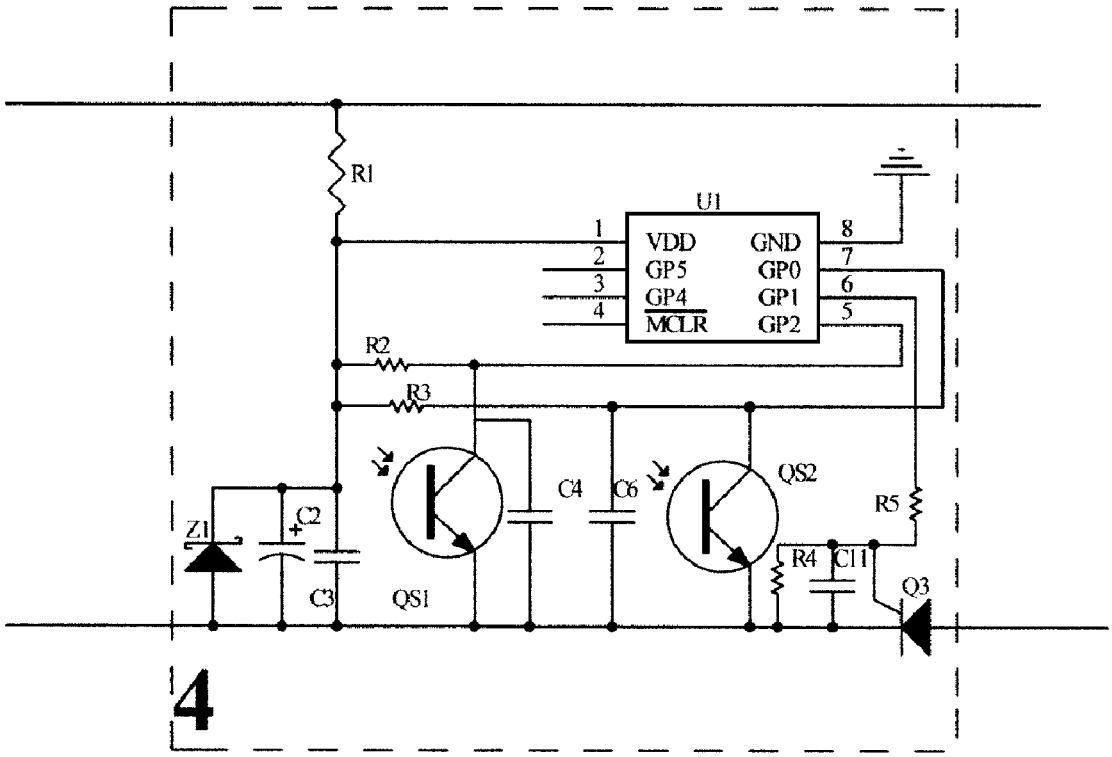
FIG. 3 is a circuit diagram of an ambient brightness signal sampling and control circuit of a light control circuit according to still another preferred embodiment of the present invention.

According to the embodiment, the photosensitive element is a photoresistor (RS1, RS2). Alternatively, it can be replaced with a photodiode (DS1, DS2) having a relatively high photosensitivity or a phototransistor (QS1, QS2) with an even higher photosensitivity for enhancing further the photosensitivity of the light control circuit according to the present invention, as shown in FIGS. 2 and 3.

According to the present invention, the programmable integrated circuit U1 can selectively be a PIC12F510, PIC12F675, PIC10F200, PIC10F202, PIC10F204, PIC10F206, PIC10F220, PIC10F222 or any other functionally equivalent integrated circuit. While a PIC12F510 or PIC12F675 is employed as the programmable integrated circuit U1, the power supply pin VDD will be the pin 1 of the integrated circuit U1, GND pin will be pin 8 and output pin GP1 can be selectively assigned to any one of pins 2, 3, 5, 6 and 7. The input pin of a PIC12F510 can be assigned to any one of pins 5, 6 and 7, and the input pin of a PIC12F675 can be assigned to any one of pins 3, 5, 6 and 7. While one selected from PIC10F200, PIC10F202, PIC10F204, PIC10F206, PIC10F220 or PIC10F222 is employed as the integrated circuit U1, the power supply pin VDD will be the pin 5 of the integrated circuit U1, GND will be pin 2 and the output pin can be selectively assigned to any one of pins 1, 3, and 4, and the input pin can be assigned to either pin 1 or 3. Definitely, the output pin and input pin shall be two different pins and cannot be assigned to the same pin. Further, the assignments of the VDD pin, GND pin, input pin and output pin can be adaptively amended or changed in accordance with the respective models of integrated circuits while a specific or different model of integrated circuit being selected for use as the programmable integrated circuit U1. Similarly, its external electronic devices must be correspondingly configured.

According to the embodiment of the present invention, the ambient brightness signal sampling and control circuit 4 employs two photosensitive elements. While being axially disposed on same plane in a compact type fluorescent lamp adopting and embedding the light control circuit of the present invention, the photosensitive elements shall be separated at a specific angle, preferably at 180° for the maximum coverage. While 3 or 4 photosensitive elements and respective programmable integrated circuits were employed for further enhancement of the photosensitivity and immunity to the sudden changes of the ambient brightness thereof, the photosensitive elements can be correspondingly separated at preferred angles, such as 120° and 90°, respectively. Definitely, the employment of other configurations is possible, for example, the photosensitive elements can be disposed axially and separately at a specific angle on different planes for securing the maximum coverage for the detection of ambient brightness such that the onoff of the compact type fluorescent lamp can be controlled in a more accurate manner. It should be understood that even only one photosensitive element is employed, the present invention still possesses advantages of higher photosensitivity and/or immunity to the sudden changes of ambient brightness and/or lower cost with respect to the prior art.

Accordingly, the detection of ambient brightness will not affected by the uncertainty in the ambient brightness values detected with the photosensitive elements, which might previously be subject to the constraints of the installation sites. In case a plurality of photosensitive elements are employed, a photosensitive element offering a relatively high or low detected ambient brightness value can be alternatively selected as the primary one while the others can correspondingly be selected as the auxiliary one or else all the detected values can be averaged or a weighted calculation can be preferably performed. Further, the location of respective photosensitive element and other factors, such as working mode, time, other parameters stored in the integrated circuit U1 which can be input or modified during or after the manufacturing process, or the like, and all of such factors can be used to determine weighted factors of detected input values of the photosensitive elements such that the onoff of the compact type fluorescent lamp can be controlled in a preferred manner.

According to the embodiment of the present invention, the ambient brightness signal sampling and control circuit 4 is mainly used to provide a corresponding dc voltage signal to the programmable integrated circuit U1 in accordance with the brightness of the external environment while in operation. To this end, it makes use of the photosensitive characteristic of the photosensitive elements, wherein the resistance of the photoresistors RS1, RS2 in FIG. 1 or the photodiodes DS1, DS2 under reverse bias in FIG. 2 will descend while the phototransistors QS1, QS2 will be turned on with the photocurrent based on the photovoltaic effect, whereby the DC voltage level at the input pins GP0, GP2 of the programmable integrated circuit U1 will correspondingly descend to medium or even low from high when the brightness of the external environment changes from dark to bright. With a specific program for controlling the working modes of the light control circuit being input into the programmable integrated circuit U1, the voltage level at the input pins GP0, GP2 relative to the ambient brightness can be continuously detected such that the light control circuit can selectively operates in turnon, intermediate or turnoff modes based on the detected values. Wherein the specific program can respectively define a lower and an upper threshold representing preferred boundaries of the ambient brightness and both of which can be predetermined and easily adjusted as required. While the detected ambient brightness value is kept below the lower threshold or above the upper threshold for a specific duration, and in particular the voltage level at the input pins GP0, GP2 being persistently higher or lower than a specific value, the programmable integrated circuit U1 will output accordingly a control voltage to the thyristor Q3 to enable it to be on or off thereby generating a control signal which will be subsequently sent to a control point of the frequency control and resonant circuit 2 to perform eventually the on/off operation of the lamp load 3. When the detected ambient brightness values are kept between the lower threshold and the upper threshold for the specific duration, the integrated circuit U1 will operate in an intermediate mode during which the voltage level of the input pins GP0, GP2 will be detected as usual and the control voltage at the output pin GP1 remains unchanged.

Once coupled to a power supply, the specific program is configured to have the output pin GP1 of the integrated circuit U1 to stay low persistently for a duration (can be 1-10 seconds, e.g. 5 seconds) during which the voltage level of the input pins GP0, GP2 will be detected for a single or multiple times. The output pin GP1 will change to high to eventually switch on the thyristor Q3 and then the lamp only when the input pins GP0, GP2 of U1 are persistently kept at high level or else the output pin GP1 stays low and the lamp remains off. Alternatively, the specific program can be configured to have the output pin GP1 to stay high for 5 seconds first and have the lamp to switch off after being on for 5 seconds to indicate the proper operation of the lamp.

In operation, the specific program is configured to have the ambient brightness to be continuously detected and determined for a single or multiple times in a predetermined interval (can be 0-300 seconds), if the determined ambient brightness values namely the result of weighted calculation stay below the lower threshold, which means the input pins GP0, GP2 of the integrated circuit U1 persistently stay high during the period. After going through a proper time delay, the output pin GP1 will output a high level to turn on the thyristor Q3 and thus the lamp is switched on. Owing to the intrinsic deviation among the electronic elements and devices, when a plurality of light control lamps are employed in the same site, there will be minor differences among the detected values of the photosensitive elements of each of the light control lamps in responsive to the same ambient brightness change. Similarly, there will be minor differences among the ambient brightness in each of the subareas in which each of the light control lamps is installed. Accordingly, when a plurality of light control lamps are employed, there will be also minor differences in response lag of each of the light control lamps in responsive to the ambient brightness change. In order to prevent a light control lamp having a longer response lag from being influenced by of a light control lamp having a shorter response lag, it is desirable for a light control lamp to undergo an appropriate response lag before changing the working mode of the light control lamp after the ambient brightness is determined. The time duration of the response lag shall be set to a value which can ensure in an utmost manner that the ambient brightness changes can be properly determined by all the light control lamps.

Similarly, if the determined ambient brightness values stay above the upper threshold for a predetermined interval (can be 3-300 seconds), namely the results of weighted calculation of the detected values of the input pins GP0, GP2 of the integrated circuit U1 persistently stay low. After passing through a proper time delay, the output pin GP1 of U1 will cease to output a high level whereby the thyristor Q3 automatically turns off during the zero cross operation and thus the lamp is then switched off. If the determined ambient brightness values of the input pins GP0, GP2 being found not at low level for at least once during the detection process, the entire process will be restarted for ensuring that the ambient brightness signal sampling and control circuit 4 is not susceptible to a sudden change of the ambient brightness.

While the ambient brightness values determined by weighted calculation with the voltage levels of the input pins GP0, GP2 of the integrated circuit U1 persistently stays at intermediate level, namely the ambient brightness is continuously detected and found as in between the upper and the lower thresholds, the output voltage of the output pin GP1 remains unchanged whereby the latest operating mode of the lamp will also be retained.

According to the embodiment of the present invention, once the light control fluorescent lamp coupled to a power supply, the specific program is configured to have the output pin GP1 of the integrated circuit U1 output initially a low level for a duration, for example 5 seconds, during which the voltage level of the input pins GP0, GP2 will be detected for multiple times such that the onoff of the fluorescent lamp can be correspondingly controlled.

In case of the ambient brightness is determined to be stayed below the lower threshold for a predetermined interval, such as 10 seconds. The output pin GP1 will output a high level to turn on the thyristor Q3 whereby the frequency control and resonant circuit 2 can work normally and the lamp is eventually switched on.

Similarly, in case of the ambient brightness is detected and determined in a frequency of once per every 1.5 seconds within a predetermined interval, such as 15 seconds, and all the detected ambient brightness values stay above the upper threshold, the output pin GP1 of U1 can cease to output a high level such that the thyristor will be automatically turned off during the zero cross operation whereby the frequency control and resonant circuit 2 will eventually cease operation and the fluorescent lamp is then switched off. If the weighted ambient brightness values of the input pins GP0, GP2 being determined to be not at low level for at least once during the detection process, the entire process will be restarted for ensuring that the light control circuit is not susceptible to a sudden change of the ambient brightness.

In case the ambient brightness values determined by weighted calculation with the voltage levels of the input pins GP0, GP2 of the integrated circuit U1 stay persistently at intermediate level, namely the ambient brightness is continuously detected and found as in between the upper and the lower thresholds defined by the specific program stored in the integrated circuit U1, the output voltage of the output pin GP1 remains unchanged whereby the latest operating mode of the lamp will be also remained unchanged.

It should be obvious that the ambient brightness signal sampling and control circuit 4 of the present invention characterized by featuring an integrated circuit U1 for performing calculation and a thyristor Q3 for controlling the on/off operation, respectively. As these devices are relative small in size thereby rendering the light control circuit and light control fluorescent lamp to be simple in construction, more reliable in operation with respect to the prior art lamps as it employs at least one photosensitive element having a higher photosensitivity whereby they are preferably adapted for use in a compact type fluorescent lamp.

While the invention has been described with references to above preferred embodiments, it will be understood by those skilled in the art that various changes, additions or deletions may be made and equivalents may be substituted for elements thereof without departing from the spirit and scope of the invention and its claims. The above embodiments are merely exemplary but not limitative examples. For example, the external component or circuitry of the integrated circuit U1 will differ and may need adaptive modification when a different model of IC is employed as the integrated circuit U1. The frequency control and resonant circuit 2 can also adopt any other circuitry having a controllable point or junction, and all such alteration and/or modification shall fall into the scope of the present invention.

What is claimed is:

1. A light control circuit for use in light control fluorescent lamps comprises a filter and rectifier circuit (1) with its input coupled to an AC power supply; a frequency control and resonant circuit (2) with its input coupled to output of the filter and rectifier circuit (1); an ambient brightness signal sampling and control circuit (4) with its input coupled to the output of the filter and rectifier circuit (1) while its output being coupled to the frequency control and resonant circuit (2); the ambient brightness signal sampling and control circuit (4) includes a programmable integrated circuit (U1), and a resistor (R1) serially connected to a capacitor (C3) in shunt connection with a polarized capacitor (C2) and a zener diode (Z1) between a positive input and a negative input of the ambient brightness signal sampling and control circuit (4); wherein a power supply pin (VDD) of the integrated circuit (U1) is coupled to a connection point between the resistor (R1) and the capacitor (C3), and a ground pin (GND) of the integrated circuit (U1) and the negative input being grounded together; characterized in that:

the integrated circuit (U1) of the ambient brightness signal sampling and control circuit (4) comprises at least one input pin (GP0, GP2), an output pin (GP1) and a specific program for controlling working mode of the light control circuit;

the ambient brightness signal sampling and control circuit (4) further comprises:

a photosensitive element in shunt connection with a capacitor (C4, C6) being respectively connected between the at least one input pin (GP0, GP2) and the negative input;

a resistor (R2, R3) respectively connected between the at least one input pin (GP0, GP2) and the power supply pin (VDD); and a resistor (R5) connected to the output pin (GP1) at one end and coupled to a gate of a thyristor (Q3) at another end, and a resistor (R4) and a capacitor (C11) being in shunt connection between the gate and a cathode of the thyristor (Q3); and the cathode of the thyristor (Q3) is further connected to the negative input.

2. A light control circuit according to claim 1, wherein the photosensitive element is a photoresistor (RS1, RS2).

3. A light control circuit according to claim 1, wherein the photosensitive element is a photodiode (DS1, DS2).

4. A light control circuit according to claim 1, wherein the photosensitive element is a phototransistor (QS1, QS2).

5. A light control circuit according to claim 1, wherein the programmable integrated circuit (U1) is a PIC12F510, PIC12F675, PIC10F200, PIC10F202, PIC10F204, PIC10F206, PIC10F220, PIC10F222 or any other functionally equivalent integrated circuit.

6. A light control circuit according to claim 1, wherein the specific program is configured to continuously detect the ambient brightness for a single or multiple times in a predetermined interval with the at least one photosensitive element and then selectively operates in turnon, intermediate or turnoff modes based on detected brightness thereby controlling the onoff of the light control circuit correspondingly.

7. A light control circuit according to claim 6, wherein the specific program is configured to enable the ambient brightness signal sampling and control circuit (4) to operate in the turnon mode or intermediate mode thereby rendering the light control circuit to be turned on or remained on while the ambient brightness being remained below a lower threshold for a specific duration.

8. A light control circuit according to claim 7, wherein the specific duration can selectively ranges from 0 to 300 seconds.

9. A light control circuit according to claim 6, wherein the specific program is configured to enable the ambient brightness signal sampling and control circuit (4) to operate in the turnoff mode or intermediate mode thereby rendering the light control circuit to be turned off or remained off while the ambient brightness being remained above an upper threshold for a specific duration.

10. A light control circuit according to claim 9, wherein the specific duration can selectively ranges from 3 to 300 seconds.

11. A light control circuit according to claim 6, wherein the specific program is configured to enable the ambient brightness signal sampling and control circuit (4) to keep the onoff of the light control circuit unchanged while operating in the intermediate mode.

12. A light control circuit according to claim 1, wherein the specific program is configured to enable the light control circuit to go through, once coupled to the power supply, a response lag of 1-10 seconds during which the ambient brightness is detected and determined for enabling it to control the onoff of the light control circuit correspondingly.

13. A light control circuit according to claim 1, wherein the integrated circuit (U1) of the ambient brightness signal sampling and control circuit (4) comprises two input pins (GP0, GP2) coupled respectively with two photosensitive elements.

14. A compact type light control fluorescent lamp comprises a light control circuit of claim 1 and a lamp load (3) coupled with the output of the frequency control and resonant circuit (2).

15. A compact type light control fluorescent lamp of claim 14, wherein the integrated circuit (U1) of the light control circuit comprises two input pins (GP0, GP2) coupled respectively with two photosensitive elements disposed axially and separated at a specific angle within the compact type light control fluorescent lamp.

16. A compact type light control fluorescent lamp of claim 15, wherein the specific angle is 180°.

* * * * *